United States Patent [19]

Stevens et al.

[11] Patent Number: 4,460,643

[45] Date of Patent: Jul. 17, 1984

[54] NONWOVEN FIBROUS BACKING FOR VINYL WALLCOVER

[75] Inventors: William P. Stevens, Oneida, Wis.; Claudio Orefice, Enfield, Conn.

[73] Assignee: The Dexter Corporation, Windsor Locks, Conn.

[21] Appl. No.: 464,391

[22] Filed: Feb. 7, 1983

[51] Int. Cl.[3] ..... B32B 7/00

[52] U.S. Cl. ..... 428/284; 428/286; 428/287; 428/290; 428/298; 428/326; 428/343; 428/354; 428/904.4

[58] Field of Search ..... 428/284, 286, 290, 343, 428/354, 904.4, 287, 326, 298

[56] References Cited

U.S. PATENT DOCUMENTS

| | | | |
|---|---|---|---|
| 4,039,709 | 8/1977 | Newman | 428/904.4 |
| 4,140,566 | 2/1979 | Burton et al. | 428/904.4 |
| 4,197,343 | 4/1980 | Forsythe | 428/904.4 |
| 4,205,110 | 5/1980 | Jean | 428/904.4 |
| 4,219,376 | 8/1980 | Roman | 428/904.4 |
| 4,296,162 | 10/1981 | Jean | 428/904.4 |

*Primary Examiner*—James J. Bell

*Attorney, Agent, or Firm*—Prutzman, Kalb, Chilton & Alix

[57] ABSTRACT

A wallcover backing for strippable vinyl wallcovering comprises a dimensionally stable unitary multistratum nonwoven fibrous web material that can be coated with or laminated to a vinyl layer. The backing material has a fibrous top phase adapted for secure nondelaminating engagement with the vinyl layer superimposed thereon and a fibrous base stratum integrated with the top phase and adapted for strippable adhering engagement with a wall or the like. The top phase constitutes at least 5 percent by weight of the web and has a smooth exposed surface for direct adhesion to the vinyl layer. The web includes about 15 to 45 percent by weight of a hydrophobic latex binder and contains an adhesive penetration inhibitor adapted to inhibit the migration of a wallcover adhesive into the fibrous web material and to promote uniform and full strippability of the web from the wall to which it is adhered.

9 Claims, No Drawings

NONWOVEN FIBROUS BACKING FOR VINYL WALLCOVER

TECHNICAL FIELD

The present invention relates generally to wallcovering and is more particularly concerned with a new and improved nonwoven fibrous backing material for vinyl wallcovering and the like.

BACKGROUND OF THE INVENTION

Originally, wallcovering was simply paper printed with a design and suited for being pasted to a wall or other surface for decorative purposes. In the 1920's vinyl wallcover was introduced and had a backing of woven fabric or scrim that not only facilitated hanging of the paper, but also provided strippability characteristics not previously provided by the printed papers. Unfortunately, the fabric backed vinyl wallcover was substantially more expensive than the simple printed paper and exhibited physical disadvantages relating to permeability and adhesion. Subsequently, wallcover manufacturers began to use paper and then nonwoven material as a backing for their vinyl wallcover products. Although the paper backings are somewhat less expensive than the nonwoven backings, they are not as pleasing aesthetically, are physically less durable, and are far more difficult to process into the desired end product. The nonwoven material, on the other hand, is less expensive than the woven backing while at the same providing superior strength, toughness, softness, and embossability retention relative to the paper backing material.

The nonwoven material used as vinyl wallcover backing is typified by the inclusion of stronger, tougher synthetic fiber that may be present in amounts from approximately 5 percent to more than 50 percent of the total fiber content of the material. The synthetic fibers use heretofore typically have been polyester fibers and constitute about 50 percent of the total fiber content of the backing material. This is particularly important for vinyl wallcovers since such fibers assured hangability without stretch or deformation.

Vinyl wallcover is produced by providing a layer of vinyl on the nonwoven backing. Theoretically this can be accomplished by one of two distinctly different techniques—coating with a plastisol or laminating with a vinyl film. The plastisol coating technique uses a reverse roll, rotary screen, doctor blade or similar technique. In the former instance, the procedure has the disadvantage of a severe hydraulic shear action on the surface of the backing material since the applicator roll is turning at approximately three times the speed of the backing carrier roll and is moving in a reverse roll direction. This causes substantial pilling on the surface of the nonwoven backing, particularly on those nonwoven backing materials that utilize a high polyester fiber content since the ends of the synthetic fibers are exposed to the shearing action of the procedure. The pilled surface of the backing tends to show through the vinyl plastisol layer and provides an aesthetically displeasing result. The synthetic fiber ends of the nonwoven material tend to cause dimpling when the vinyl plastisol coating is applied. Bleed through of the plastisol with its resultant uneven coating that adversely affects the printing of the design on the vinyl surface has also been problem. Because of these difficulties the coating process is seldom employed with nonwoven backing on a commercial basis.

Where the vinyl layer or surface is applied by laminating a preformed vinyl film onto a substrate or backing, it has been necessary to utilize an adhesive plus a heated calender roll to drive off the solvent. That technique not only requires the preparation of the adhesive with its attendant cost but also involves high energy usage associated with removing water or other solvent from the adhesive layer. Further, the volatility of the adhesive solvents used in laminating the preextruded film to the backing tends to result in an undesirable environmental condition.

SUMMARY OF THE INVENTION

According to the present invention, it has been found that a unitary but multiphase nonwoven fibrous backing will enable wallpaper manufacturers to make a functionally improved product at lower cost than has been possible with wallcover backing presently on the market. This unitary multiphase or multistratum fibrous web material not only provides coatability without pilling, but also imparts superior aesthetic qualities to the resultant wallcovering. A coated wallcover now becomes a commercial reality and even eliminates the need for the more expensive preextruded vinyl film. The wallcover backing of the present invention also can be used with vinyl film while advantageously eliminating many of the problems associated therewith, including the energy usage required to cure the adhesive and remove any solvent therefrom. The wallcover backing of the present invention not only provides a physically superior backing material as compared with paper but also provides improved processability, strippability, and cost savings coupled with the desirable toughness, softness, and embossability retention associated with nonwoven wallpaper backing materials.

The new and improved wallcover backing of the present invention provides a multiphase structure with the top phase free from synthetic polyester fibers. Additionally, the top phase of the multiphase material provides a smooth coating surface completely free from polyester fiber ends thereby eliminating the pilling problems previously associated with the coating process. This wallpaper backing material permits customizing and variability in the desired product while eliminating the need for an additional adhesive where the backing is use with a preformed vinyl film. Finally, improved hangability and dimensional stability of the product is coupled with uniform, controlled, and very limited plastisol migration and adhesive penetration so as to provide uniform performance both from a strippability and coatability viewpoint.

These and related advantages are obtained in accordance with the present invention by providing a vinyl wallcover backing for strippable vinyl wallcovering comprising a dimensionally stable unitary multistratum nonwoven fibrous web material. This material has a fibrous top stratum adapted for secure nondelaminating engagement with a vinyl layer superimposed thereon, and a fibrous base stratum integrated with the top stratum and adapted for strippable adhering engagement with a wall or the like. The top stratum constitutes at least 5 percent by weight of the multistratum web and has a smooth exposed surface for direct adhesion to the vinyl layer. The multistratum web includes about 15 to 45 percent by weight of a latex binder and contains an adhesive penetration inhibitor adapted to inhibit the migration of a wallcover adhesive into the fibrous web material and to promote uniform and full strippability of the web from the wall to which is applied.

A better understanding of this invention will be obtained from the following description of the wallcover backing, and the process for its manufacture including the several steps of that process and the relation of one or more of such steps with respect to each of the others and the article of manufacture possessing the features, characteristics, compositions, properties, and relation of elements described and exemplified herein.

DETAILED DESCRIPTION

The multistratum wallcover backing of the present invention generally may include substantially the same bottom phase or stratum regardless of the process to be employed in applying the vinyl layer thereto. However, the top phase of the multistratum nonwoven web material typically will vary depending upon the particular process used to apply the vinyl layer. For example, where the vinyl layer is to be applied as a liquid plastisol via a coating technique using a reverse roll rotary screen or knife coating process, the top phase consists primarily of synthetic wood pulp, natural cellulosic fibers or a mixture thereof with the synthetic wood pulp at least partially fused to present an extremely smooth surface to the plastisol coating operation. On the other hand, where a preformed vinyl film is to be applied as the vinyl layer, it is preferred that the top stratum contain thermoplastic heat sealable fibers that exhibit a high affinity for the vinyl film. In this way, the heat sealable fibers firmly and securely bond the preformed vinyl layer to the backing without the need for additional adhesives and without the need to expend the energy necessary to drive off solvents, such as water vapor, from the adhesive utilized to adhere the vinyl film to the backing material.

In carrying out the present invention the multiphase material preferably is produced in the form of a continuous water-laid nonwoven web material using known and conventional papermaking techniques. The wet papermaking process involves the general steps of forming separate fluid dispersions of the requisite fibers for each phase and sequentially depositing the dispersed fibers on a fiber collecting wire in the form of a continuous sheet-like web material. The fiber dispersions may be formed in a conventional manner using water as a dispersant or by employing other suitable fiber dispersing media. Preferably, aqueous dispersions are employed in accordance with known papermaking techniques. The fiber dispersion is formed as a dilute aqueous suspension of papermaking fibers, i.e., a fiber furnish. The fiber furnish is conveyed to the web forming screen or wire, such as a Fourdrinier wire, of a papermaking machine and the fibers are deposited on the wire to form a fibrous web or sheet that is subsequently dried in a conventional manner. The web material thus formed is treated either before, during or after the complete drying operation with a latex treating solution used in accordance with the present invention, but in the preferred embodiment is treated subsequent to the drying operation.

As mentioned, the invention is primarily concerned with multiphase sheet material since such material will provide effective coverage of the synthetic polyester fibers. In such material not only is the top surface substantially free of such fibers but it is quite smooth and receptive to the vinyl layer that is to be placed thereon and secured thereto. In this connection, numerous different techniques have been employed heretofore to make a multiphase fibrous web. Typical of those found most useful in the production of web materials utilized in accordance with the present invention is the multiple headbox inclined wire technique described in U.S. Pat. No. 2,414,833. In accordance with that process, a first furnish of non-heat seal fibers flows through a primary headbox and continuously deposits as a first or bottom phase on an inclined fiber collecting screen. A second furnish containing fibers for the top phase is introduced into the headbox at a location close to but slightly downstream of the point of deposition of the fibers from the first furnish. The introduction of the second furnish may be carried out by means of an inclined trough, by a secondary headbox or by other means in such a manner that the fibers from the second fiber furnish comingle slightly with the fibers forming the bottom phase but only after a portion of those fibers have been deposited on the inclined wire. In this way, the fibers within the bottom phase have a chance to provide a base prior to the deposition of the fibers forming the top phase. As is appreciated, the latter is secured to the base phase through an interface zone formed by the intermingling of the fibers from the respective furnishes. Typically, sheets produced in this manner will have fibers from only the first furnish covering the entire surface of the sheet on the surface in contact with the inclined fiber collecting screen, while the fibers of the top phase completely cover the bottom phase or stratum so as to mask the presence of the synthetic fibers therein yet at the same time utilize the strength and toughness characteristics imparted to the sheet material thereby. Additionally, in this way there is no clear line of demarcation between the two phases of the multiphase sheet material. However there is a predominence of secondary furnish fibers on the top surface of the multiphase sheet. The interface or boundary between adjacent phases, of course, is composed of a mixture of the fibers within both fiber furnishes.

The multiphase fibrous web material thus formed is typically dried in a conventional manner by passing it over drying drums heated to temperatures of about 220° F. and higher or by other conventional drying techniques. Thereafter, the multiphase fibrous web material is treated with a suitable binder, preferably a hydrophobic material, and with a penetration inhibitor to inhibit the penetration of the wallcover adhesive as well as the penetration of the plastisol when the vinyl layer is formed by a coating technique.

The bottom phase of the multiphase nonwoven web material is composed of a mixture of natural and synthetic fibers with the synthetic fibers being of the type that are thermally stable up to about 165° C. The natural cellulosic fibers used in the fiber furnish for the base phase provide not only a less expensive fiber content, but also provide a smoother surface finish to the exterior bottom surface of the multiphase nonwoven web material. The synthetic fibers, on the other hand, impart to the web material greater tear strength, higher tensile, greater toughness and elongation and better fabric like appearance and feel. Accordingly, the proportions of the synthetic fiber to natural cellulosic fiber will vary extensively, with the synthetic fiber content varying from as little as 1 to 2 percent up to about 95 to 98 percent of the total fiber furnish. Generally however, it is preferred that the synthetic fiber content of the base phase fall within the range of about 5 percent to 60 percent by weight. The amount of synthetic fiber within the base phase categorizes the entire sheet material as either a high synthetic nonwoven material or a low synthetic material. For example, if the base phase contains 50 percent or more of synthetic fiber, it is categorized as a high synthetic grade material whereas if the synthetic fiber content of the base phase is about 15 to 35 percent, the entire web material is categorized as a low synthetic type material. The amount of synthetic fiber used in the base layer, or base phase will vary somewhat, depending upon the affinity of the fibers for the subsequent treating materials as well as the particular properties desired in the resultant product.

Accordingly, a wide variety of natural and synthetic fibers may be used in the base phase. The synthetic or man-made fibers may include cellulosics such as rayon, nylons such as polyhexamethylene adipamide and aramid, acrylics such as polyacrylonitriles, high melting polyolefins such as polyethylene and polypropylene, and vinyl polymers and copolymers. However, the preferred synthetic fiber is polyester fiber such as polyethylene terephthalate in view of its cost and the characteristics it imparts to the base web material when utilized for wallcover backings; that is, dimensional stability, hangability and similar physical properties. Natural cellulosic fibers, such as bleached and unbleached Kraft, hemp, jute and similar conventional papermaking fibers may be employed. For particular applications other fibers such as glass, quartz, mineral wool and the like may be used.

The top phase of the multiphase nonwoven fibrous web material provides not only a covering of all the synthetic fibers within the base phase and the elimination of the exposure of any free ends of the synthetic fibers, but also provides a smooth surface on which to apply and affix the vinyl layer. The top phase will vary depending upon the nature of the vinyl layer being applied. For example, when using a coating technique with a vinyl plastisol, it is generally preferred that the top phase provide a tight, dense covering of the synthetic fibers, so that the plastisol readily sits on the surface of the top phase without substantially penetrating into and migrating through that phase. On the other hand, when the vinyl layer is applied by laminating a preformed vinyl film to the multiphase backing, a higher porosity, less dense top phase is employed.

Where the wallcover backing is intended for use as a coatable base, it has been found that the top phase preferably should consist of either natural cellulosic fibers, synthetic fibrid-type materials such as synthetic wood pulp, or mixtures thereof. Both the natural cellulosic fibers and the synthetic wood pulp provide a very tight fibrous web exhibiting low porosity and smooth surface characteristics. In practice, it is generally preferred that a mixture of the natural cellulosic fibers and the synthetic wood pulp be employed since the natural cellulosic fibers will provide a greater affinity for the latex binder solution used in accordance with the present invention. However where a different binder system is employed having a greater affinity for the hydrophobic synthetic pulp material, then up to 100 percent synthetic pulp may be used. Sheet materials containing a top phase of 100 percent synthetic pulp are typically weak and excessively tight thereby increasing the drainage time of the suspension during the papermaking process and requiring more expensive binder compositions in order to facilitate handling during subsequent coating operation. Consequently, it is preferred that the amount of synthetic pulp-like fiber constitute less than 90 percent by weight of the total fiber content of the top phase of the multiphase nonwoven web material and preferably between about 50 percent and 85 percent by weight on a dry weight basis.

The synthetic wood pulp is a thermoplastic polyolefinic material having a structure similar to wood pulp. That is, it contains a microfibrillar structure comprised of microfibrils exhibiting a high surface area, as contrasted with the smooth rod-like fibers of conventional man-made organic fibers. The synthetic pulps, such a polyolefins, have a structure more closely resembling wood pulp, and therefore can be more readily dispersed within an aqueous dispersing medium to achieve excellent random distribution of the synthetic material during the papermaking operation. The fiber-like particles forming the synthetic pulp have a typical size and shape comparable to the size and shape of natural cellulosic fibers. They exhibit irregular surface configurations, and have a surface area in excess of 1 square meter per gram and may have surface areas of even 100 square meters per gram. The fibers found particularly advantageous are those made of the high density polyolefins of high molecular weight and low melt index. The polymeric materials preferable have a melt index below 0.1 and a viscosity average molecular weight greater than 40,000. In fact the average molecule weight of the material typically is at least 500,000 and preferably greater than 800,000. There pulp-like fibers, such as polyethylene, polypropylene and mixtures thereof, have a fiber length well suited to the papermaking technique, e.g., in the range of 0.4 to 2.5 mm. with an overall average length of about 1 to 1.5 mm. Typical examples of these materials are the polyolefins sold by Crown Zellerbach Corporation under the designation "SWP" and "FYBREL", by Solvay and Cie under the designation "PULPEX" and by others.

Since the pure polyolefin particles are hydrophobic and have a surface tension that does not permit water wettability, the material obtained commercially is frequently treated to improve both wettability and dispersibility in the aqueous suspensions. The amount of wetting agent is however relatively small and generally is less that about 5 percent by weight, e.g., about 3 percent by weight and less. The chemically inert polyolefins are thermoplastic materials that become soft with increasing temperature, yet exhibit a true melting point due to their crystallinity. Thus, the synthetic polyolefin pulps exhibit a melting point in the range of 135° to 150° C. depending on the composition and surface treatment of the material. In this connection, the thermoplastic characteristic of the material is utilized by effecting at least a partial fusion of the synthetic wood pulp during the typical drying operation. The heat treatment causes the synthetic pulp to approach and somtimes exceed its fusion temperature. The presence of the synthetic pulp not only coats the synthetic fiber ends to a limited degree to avoid pilling during the plastisol coating operation, but also, via the fused characteristic of the material resulting from the drying, appears to provide a surface of hydrophobic character enabling the application of a thin continuous and relatively uniform vinyl layer. The diffused character of the synthetic wood pulp also assures a low porosity top phase that exhibits very low dusting characteristics and enhances the possibility of the plastisol coating sitting on the top of the semicontinuous fused film without excessively penetrating into the backing material, thus assuring a smooth and uniform exposed vinyl surface on the wallcover material.

Where the wallcover backing is to be used in connection with the lamination of a preformed vinyl film, it is preferred that the top phase of the backing exhibit substantially different characteristics and utilize substantially different fiber compositions than are used for coating backings. In this instance, it is generally preferred that thermoplastic heat sealable fibers be employed and that the fibers be of a character that exhibit an affinity for the vinyl film. In this way, the need for expensive adhesives and high energy usage for solvent removal is obviated. The preferred top phase for laminated vinyl layers contains a mixture of heat sealable thermoplastic fibers and natural cellulosic fibers. The thermoplastic material includes vinyl polymers and copolymers with the preferred material being Vinyon which is a copolymer of vinyl acetate and vinyl chloride. Where Vinyon is employed, up to about 90 percent of the fiber content of the top phase consists of such fibers with the remaining fibers being cellulosic fibers. Typically, amounts of thermoplastic fibers exceed 50 percent of the total fiber content of the top phase with the preferred amount of thermoplastic fiber exceeding the 65 percent level conventionally used in heat sealable webs. In fact amounts of about 75 to 85 percent have given the best results.

Although the proportion of fibers within the top phase and the bottom phase may vary substantially depending upon the particular end use of the multiphase wallcover backing it is generally preferred that the top phase constitute at least 5 percent and up to about 60 percent by weight of the total fiber content of the multiphase nonwoven sheet material. Typically, the top phase will constitute from about 25 to 45 percent of the total fiber content of the sheet.

The two phase sheet material preferably is dried in a conventional manner and then is treated with a latex binder and penetration inhibitor, which treatments may be conducted successively or simultaneously. Where they are conducted as separate operations, the sheet material is typically dried between each treatment; however, a single treatment with a solution containing both the binder and the inhibitor is preferred.

The latex binder system utilized is of the hydrophobic type and imparts to the web material the desired structural integrity required for wallcover backing. At the same time, the binder promotes adhesion of the backing with the vinyl covering placed thereon. The binder takes the form of an aqueous suspension or dispersion and preferably is comprised of an inherently hydrophobic and crosslinkable polymeric material that may include a small amount of surfactant in its commercial form. The specific latex suspension employed in accordance with the present invention may vary substantially depending upon the particular fibers used in the backing material; however, many of the hydrophobic latex binders used for nonwovens, such as the acrylics, polyvinyl chlorides, SFB's, vinyl ethylene latex systems and blends thereof can be effectively used. While the invention should not be limited to any specific binder material, it has been found that best results are achieved when using an internally stabilized acrylic latex emulsion of the type sold by B. F. Goodrich under the trademark "HYCAR 2600×120". This material is believed to be a latex with an polyethyl acrylate base.

The multiphase web material is also treated with a penetration inhibitor which, as mentioned, can be added to the latex binder and incorporated therein, or can be added as a separate and subsequent treatment. The penetration inhibitor should be a material that will provide the desired resistance to penetration and migration of the vinyl plastisol coating, as well as resistance to penetration of the wallpaper adhesive used to adhere the vinyl wallcover during application thereof to a suitable wall structure. In the preferred embodiment, the desired penetration resistance is achieved by utilizing a fluoro chemical treating agent commercially available. In this connection, it has been found that excellent results are obtained by using solutions and emulsions of metal complexed fluorinated salts and fluorinated polymeric treating agents that have been used commercially for resisting the penetration of aqueous fluids. One such material that has been found particularly useful for the laminating backing is the "Scotch Ban" brand fluorochemical treating agent sold under the designation "FC-824" by Minnesota Mining and Manufacturing. This resin emulsion penetration inhibitor typically may be combined with antistatic agents, extenders such as supplementary water repellent agents, buffers and the like and conventionally is applied by passing the dried binder-containing nonwoven fibrous web material through an aqueous emulsion of the penetration inhibitor and subsequently subjecting the treated sheet to a drying operation. A typical aqueous emulsion treating formulation would contain about 0.7 to 1.5 parts by volume and preferably 1.25 parts by volume of FC-824 concentrate as received from the supplier with each 100 parts of water and would be used at a treating bath temperature of about 120° to 150° F. Other fluoro chemical materials having similar characteristics include metal complex solutions such as FC-805, a solution of a chromium complex of N-ethyl-N-heptadecylfluoro-octane sulfonyl glycine. These are employed particularly on coating backing sheets. Other fluid repellant agents such as waxes, silicones, urethanes, sizing aids, parafin and the like may be used.

The penetration inhibitor is applied by dipcoating when used as either a separate treatment or when applied simultaneously with the application of the latex binder. When applied separately, a solution or emulsion containing lower concentrations of the treating material provide excellent results. When the penetration inhibitor is combined with the latex binder, the amount of inhibitor utilized may constitute from 1 percent to 5 percent solids based on the solids within the latex binder emulsion. The emulsion is adjusted so that the multiphase web material will pick up from about 25 to about 40 percent by weight of its final weight from the treating process. The preferred pick up rate is about 30 to 35 percent in order to provide the desired characteristics. However, when the backing is to be utilized in a laminating process rather than a coating process, less latex binder is required and typically is preferred so as not to interfere with the heatsealable character of the top phase of he multiphase web material used in the laminating process. However, a pick up of at least 15 to 18 percent should be obtained to provide the desired strippability for the backing.

The following examples are given for purposes of illustration only in order that the present invention may be more fully understood. These examples are not intended to in any way limit the practice of the invention. Unless otherwise specified, all parts are given by weight.

EXAMPLE 1

A two phase nonwoven web material was made on an inclined wire papermaking machine using two separate fiber furnishes. The first fiber furnish contained 80 percent by weight of a high cedar containing bleached Kraft pulp sold under the name "Crofton" and 20 percent by weight of polyethylene terephthalate fibers having a denier of 1.5 and a length of about ¼ inch. This furnish was used to form the bottom phase of a two phase sheet material. The top phase was made from a fiber furnish containing 16 percent of the high cedar containing bleach Kraft pulp, 80 percent of a synthetic wood pulp sold under the name "PULPEX" and consisting primarily of polyolefin fibers and 4 percent by weight of flock. The sheet was formed so that the base phase consisted of about 70 percent by weight of the total multiphase sheet material and the top phase consisted of the remaining 30 percent based on the total fiber weight.

The resultant sheet material was dried and exhibited a basis weight of 20.1 pounds per ream (1.0 ounce per square yard). Using a single dip method, the sheet material was then treated with a latex binder dispersion of an ethylacrylate binder sold under the trade designation "HYCAR 2600×120". The dispersion contained about 5 percent of a chromium complex fluoro chemical sold under the designation "FC-805" by Minnesota Mining and Manufacturing. The solution also contained minor amounts of a melamine formaldehyde crosslinking agent, a defoamer, a fluorochemical stabilizer and ph adjuster. Treatment of the nonwoven material with the latex dispersion resulted in a pick up of 31.7 percent so that the total weight of the treated material after drying was 30 pounds per ream (1.5 ounce per square yard). The material was dried and then coated with a plastisol giving good plastisol coatability with very little migration. The percent penetration of the plastisol was 3 percent and the strippability was measured at 0.88 lbs/inch.

EXAMPLE 2

The procedure of Example 1 was repeated except that the fiber furnish was altered in the bottom phase. The same fibers were employed; namely, bleached Kraft pulp and polyester fibers. However, the amount of each fiber within the bottom phase was altered so that the content thereof was approximately equal; namely, 50 percent polyester fibers and 50 percent blached Kraft. The top phase remained unchanged and the weight of the resultant material was approximately the same. The two phase sheet material formed using the above mentioned fiber furnish was treated with the same latex/binder penetration inhibitor solution to provide a pick up of about 29 percent. After drying, the material was tested for coatability and was found to provide a good plastisol coatability with very little migration. The physical properties of the backing were similar to those of Example 1 but the sheet was thicker exhibited higher strength characteristics.

EXAMPLE 3

A heatsealable two phase wallcover backing was prepared using the same technique as in the previous examples. In this case, the base phase consisted of a fiber furnish having 56 percent bleached Kraft pulp, 37 percent polyester fibers and 7 percent of the synthetic wood pulp. The top phase consisted of 85 percent Vinyon fibers having a length of ½ inch and a weight of 3 dpf. and 15 percent unbleached Kraft pulp. The top phase constituted 38 percent of the total basis weight of the untreated material, which had a basis weight of 16.69 pounds per ream. Two phase heatseal web material was treated with a latex binder solution similar to that used in Example 1, except that the fluorochemical was changed to the polymeric emulsion sold under the designation "FC-824" by Minnesota Mining and Manufacturing. After dip treating the material within the latex binder suspension, the resultant product exhibited a pickup of 25 percent by weight and dry basis weight of 22.25 pounds per ream. The sheet material was then laminated to a preformed 8 mil. vinyl film by first heating the backing material to about 280° F. for 30 seconds in order to render the heatseal thermoplastic fibers tacky. The preformed film was then adhered to the backing with good results after 10–15 seconds at 280° F. under a compression of about 45 psi.

The sheet material was also tested with respect to strippability of the material from a test panel and was found to readily separate from the test panel leaving little or no fibers on the test panel from the backing material. The strippability was measured as 0.5 lbs/inch.

As will be appreciated by those skilled in the art, various modifications, adaptations and variations of the foregoing specific disclosure can be made without departing from the teaching of the present invention.

We claim:

1. A wallcover backing for strippable vinyl wallcovering comprised of a dimensionally stable unitary, multistratum, nonwoven fibrous web having a fibrous top stratum for secure nondelaminating engagement with a vinyl layer superimposed thereon and a fibrous base stratum integrated with said top stratum for strippable adhering engagement to a wall or the like, said top stratum comprising at least 5 percent by weight of the web and having a smooth exposed surface for direct adhesion to the vinyl layer, said multistratum web including about 15–45 percent by weight of a binder, at least said base stratum containing an adhesive penetration inhibitor to inhibit migration of a wallcover adhesive into the fibrous web and to promote strippability of the web from the wall, said top stratum including up to at least 90 percent by weight of a fusable thermoplastic fibrous material, said base stratum including at least 15 percent by weight of a synthetic fiber thermally stable up to at least the fusion temperature of said fusable fibrous material, said synthetic fibers having free ends at the surfaces of the base stratum, said top stratum being present in an amount sufficient to completely cover all the synthetic fiber free ends confronting said top stratum.

2. The wallcover backing of claim 1 wherein the synthetic fibers are thermally stable up to at least 165° C.

3. The wallcover backing of claim 1 wherein said binder comprises a hydrophobic polymeric latex material and said binder comprises 25–40 percent by weight of the web.

4. The wallcover backing of claim 1 wherein the penetration inhibitor is a fluorinated material and is present in amounts of less than 5 percent by weight.

5. The wallcover backing of claim 1 wherein the top stratum is comprised of fibers selected from the group consisting of natural cellulosic fibers, fusable synthetic wood pulp, heatsealable thermoplastic fibers having an affinity for bonding to a vinyl film and mixtures thereof.

6. The wallcover backing of claim 5 wherein the top stratum is comprised of a mixture of natural cellulosic fiber and synthetic wood pulp.

7. The wallcover backing of claim 5 wherein the top stratum is comprised of a mixture of natural cellulosic fibers and heatsealable vinyl copolymer fibers.

8. The wallcover backing of claim 2 wherein the synthetic fibers constitute up to at least 50 percent by weight of the fiber content of the base stratum and include polyester fibers.

9. The wallcover backing of claim 1 wherein the top stratum comprises 25–45 percent of the total fiber content and the latex binder and inhibitor comprise 25–40 percent by weight of the backing.

* * * * *